343-872 SR
9/28/76 XR 3,983,562

United States Patent [19]

Blanchard et al.

[11] B 3,983,562

[45] Sept. 28, 1976

[54] MONO-LOBED SCANNER

[75] Inventors: William C. Blanchard; James E. Kreiner, Jr., both of Baltimore, Md.

[73] Assignee: The Bendix Corporation, Southfield, Mich.

[22] Filed: Mar. 28, 1975

[21] Appl. No.: 563,244

[44] Published under the second Trial Voluntary Protest Program on January 27, 1976 as document No. B 563,244.

[52] U.S. Cl. ..... 343/815; 343/839; 343/840; 343/872

[51] Int. Cl.[2] ..... H01Q 19/16

[58] Field of Search ..... 343/840, 761, 781, 839, 343/815, 872

[56] References Cited

UNITED STATES PATENTS

| | | | |
|---|---|---|---|
| 2,846,678 | 8/1958 | Best | 343/840 |
| 3,276,022 | 9/1966 | Brunner | 343/840 |
| 3,386,100 | 5/1968 | Jaszberenyi | 343/839 |
| 3,680,144 | 7/1972 | Low et al. | 343/840 |

*Primary Examiner*—Archie R. Borchelt
*Assistant Examiner*—Tommy P. Chin
*Attorney, Agent, or Firm*—W. G. Christoforo; Bruce L. Lamb

[57] ABSTRACT

A mono-lobed scanner used in a direction finding radar receiver has an antenna in the form of a parabolic dish having four parallel dipole antenna elements which are located physically about the parabola focal point. The outputs of the dipole elements are combined to produce a sum signal, a delta elevation signal and a delta azimuth signal. Pointing or positional inaccuracy of the antenna caused by cross polarization products is corrected by manipulation of metalic rods located about the dipoles and in relatively close proximity thereto.

9 Claims, 8 Drawing Figures

MONO-LOBED SCANNER

BACKGROUND OF THE INVENTION

This invention relates to antennas for direction finding radar receivers and particularly to improvements for such antennas to correct for pointing inaccuracies caused by cross polarization between the receiver antenna and a transmitting antenna.

An antenna for a direction finding radar receiver usually comprises a parabolic dish pointed in the direction of a radar signal source which can be a radar transmitting element. Known receiving antennas include an array of receiving elements, usually four dipole elements, about the parabola focal point. The signals intercepted by the dipoles are combined to generate a sum signal, a delta elevation signal and a delta azimuth signal. A fifth dipole element can optionally be mounted at the boresight axis. The sum signal can be obtained from this element and the delta elevation and delta azimuth signals derived from the other dipole element are used in a known manner to maintain the boresight axis of the antenna through the transmitting element or target so long as polarization of the transmitted signal corresponds to the receiving antenna polarization. Specifically, the delta elevation and delta azimuth signals are switched and phase shifted and further combined with the sum signal to simulate a single signal being sequentially lobbed about the true array boresight axis. The amplitude modulation of this combined signal is used to provide tracking error information to the tracking servo elements of a tracking radar. So long as the target being tracked produces radar signals which are properly polarized with respect to the receiving antenna elements, the tracking radar will align itself to hold the target on the boresight axis. If, however, the target signal becomes cross polarized with respect to the receiving antenna, the apparent location of the transmitting element in space will be found to have shifted causing the radar antenna to be driven so that its boresight axis no longer intercepts the transmitting element. The result of the apparent shift of the transmitting element in space is termed pointing or positional inaccuracy caused by cross polarization products. It is the major object of this invention to provide means for compensating for this inaccuracy.

The means used to compensate for positional inaccuracy comprise sets of metalic rods spaced about the receiving dipole array with one end of each rod butt fastened to the dipole array ground plane, the rods extending generally parallel to the antenna boresight axis between a dipole array ground plane and the parabolic dish, with the other end of the rods butt fastened to the parabolic dish and evenly spaced about the boresight axis. It has been found, however, that if the rod ends at the dipole array ground plane, which is fixed with respect to the parabolic dish, are not evenly spaced about the boresight axis but are instead circumferentially adjusted, the positional inaccuracy caused by cross polarization products can be eliminated or its effect greatly attenuated.

The invention has particular utility for equipment used in meterological studies where an airborne balloon has suspended therefrom a radar transmitter including a transmitting antenna which is generally polarized with a ground located direction finding radar which tracks the balloon as it is borne on air currents to thus provide certain meterological data. If the pendulous balloon-borne transmitter should swing with respect to the balloon, as is normally the case, the transmitting antenna element, which is not normally stabilized, will become misaligned with respect to the receiving antenna producing the aforementioned positional inaccuracy caused by cross polarization products. If no means are provided for compensating or eliminating these inaccuracies it is possible under certain circumstances for the resultant errors in the derived meterological data to exceed accepted norms.

DESCRIPTION OF THE PREFERRED EMBODIMENT

Figure 1:
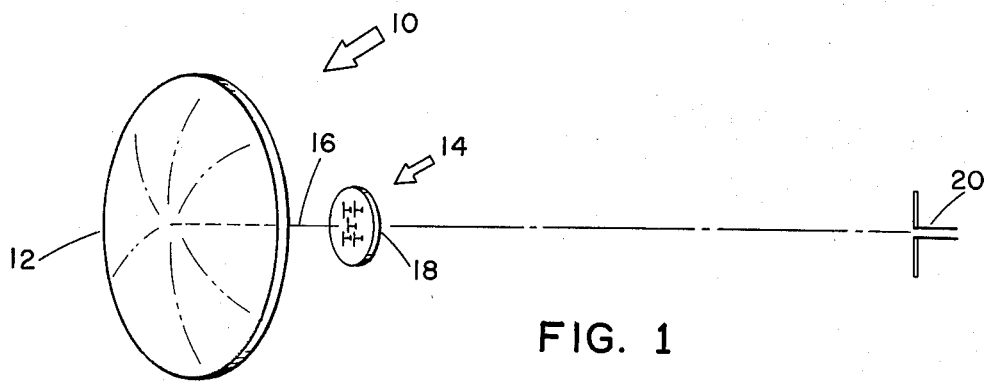
FIG. 1 schematically shows a direction finding radar receiver antenna tracking a dipole transmitting target.

Referring to the figures wherein like numerals refer to like elements and in particularly referring to FIG. 1 there is seen a direction finding radar receiver antenna comprised of a parabolic dish 12 and an active antenna array 14 spaced therefrom and centered on the boresight axis of the dish. The active antenna array is seen to be comprised of four dipole elements spaced about the antenna boresight axis and an optional fifth dipole element coinciding with the boresight axis. The dipole antenna elements are mounted on ground plane 18. For clarity, the means for mounting the active array 14 to the parabolic dish 12 are not shown in this figure nor are the means for collecting the electrical signals from the dipole elements seen, this latter means being deemed obvious to one skilled in the art. Antenna 10 is associated with means (not shown) which drives the antenna so that its boresight axis generally intercepts an appropriate radar signal source or target here illustrated as dipole 20. The closeness with which the antenna boresight axis 16 tracks source 20 is termed the positional or pointing accuracy of the radar system and in known direction finding radars the positional accuracy is relatively good so long as the signal emanating from source 20 is correctly polarized with respect to active antenna array 14. If, however, source 20 should be rotated about its longitudinal axis so as to change the relative polarization of the signals emanating therefrom, even though source 20 may not be otherwise moved in space, antenna 10 will interpret this rotation as a lateral translation in space by source 20 causing antenna 10 to be driven to a new position resulting in a positional error or inaccuracy due to cross polarization products. In the means to be described for correcting or compensating for this positional inaccuracy it is assumed that the axis through the various dipoles of the active antenna element 14 are at all times maintained parallel to one another with the dipoles polarized alike.

Figure 2:
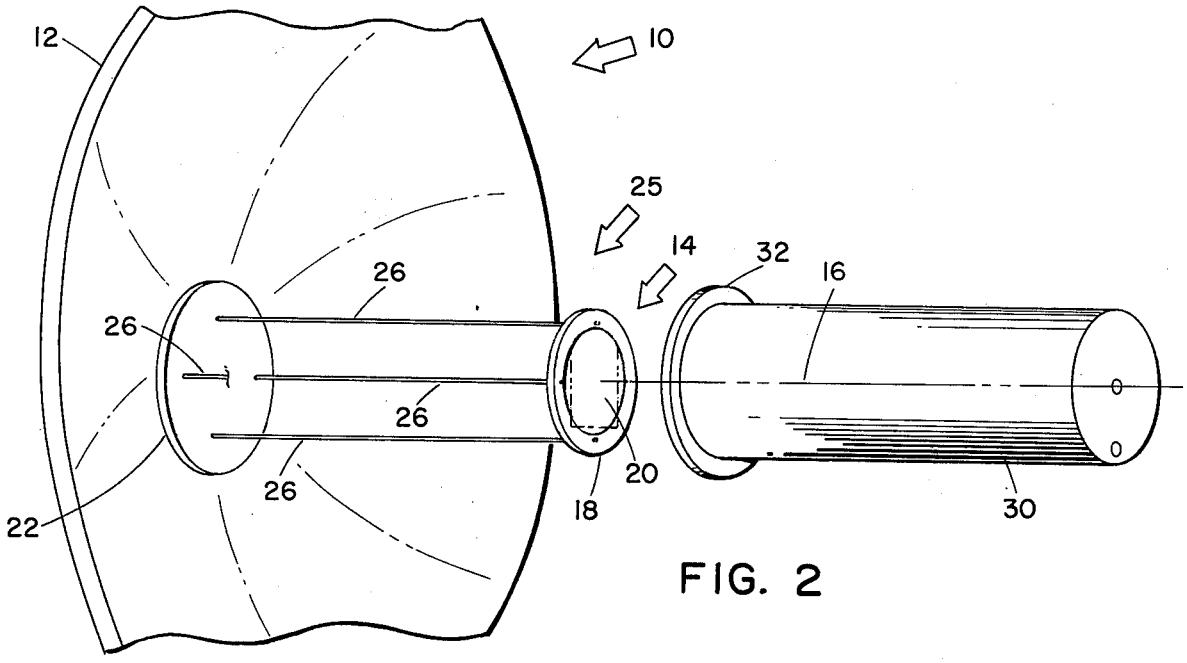
FIG. 2 shows an antenna constructed in accordance with the principles of this invention.

Refer now to FIG. 2 wherein antenna 10 is seen in greater detail and wherein active antenna array 14 is seen to be part of a larger assembly or structure 25 having a circular plate 22 centrally fastened to dish 12 and spaced apart from ground plane 18 by four metallic rods 26. The dipole receiving elements are not seen in this view, being mounted on the opposite side of ground plane 18 and directed into the concave surface of dish 12. It should be understood that the dipole elements are structurally fastened to ground plane 18, there being seen spaced off ground plane 18 a means 20 for making electrical communication with the dipole elements. Means such as this are well known to those skilled in the art and need not be described further. The longitudinal axis of structure 25 generally coincides with the antenna boresight axis. A cylindrical radome 30 having a mounting flange 32 adapted to be connected to dish 12 at plate 22 and over structure 25 is shown removed for purposes of illustration. The longitudinal axis of radome 30 when in place generally coincides with the boresight axis.

Figure 3:
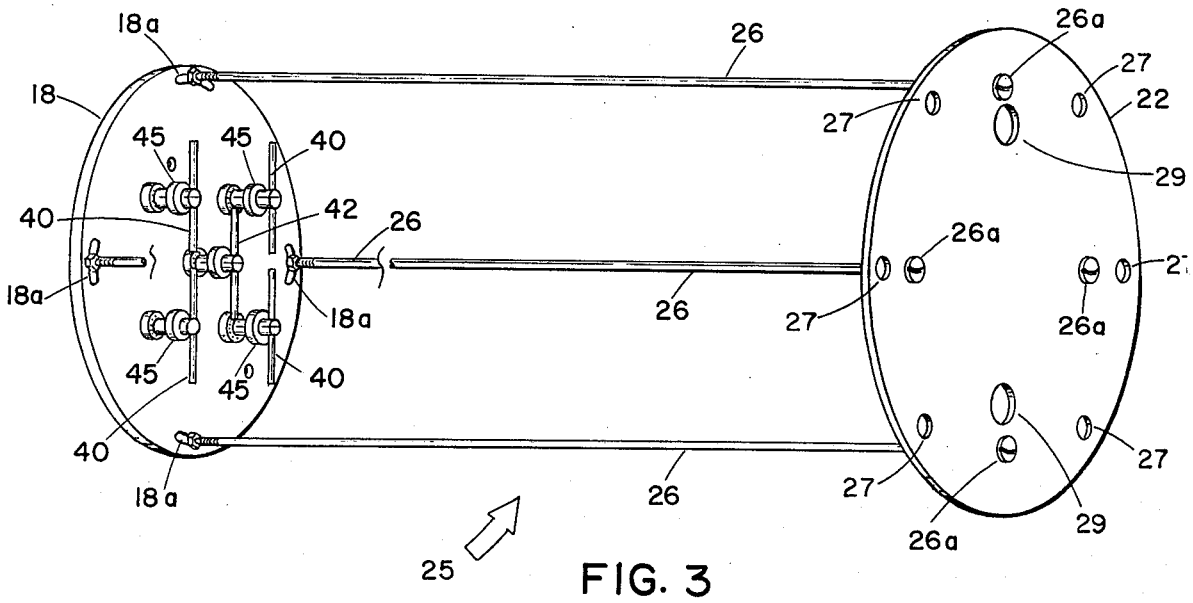
FIG. 3 shows certain elements of the invention in isometric view.

Refer now to FIG. 3 where structure 25 is seen in greater detail and in view to show the dipoles of the active antenna array. As previously explained, the active antenna array comprises four dipoles 40 located about the antenna boresight axis and an optional fifth dipole element 42 which coincides with the boresight axis. As known to those skilled in the art, the signals from the four dipole elements 40 can be combined to produce a sum signal, a delta elevation signal and a delta azimuth signal. In the alternative, the optional fifth dipole element 42 can be used to produce the sum signal with the elements 40 being used to produce the delta elevation and the delta azimuth signals. In any event, the dipole elements are positioned so as to be polarized alike. Each dipole element includes a sliding dielectric collar 45, suitably of teflon material which is used in a known manner to tune the various dipole elements. Also as previously mentioned, the dipole elements are structurally fastened to ground plane 18. A plate 22 adapted for mounting structure 25 to dish 12 and also for mounting radome 30 thereon, is spaced apart from ground plane 18 by four rods 26. Rods 26 are fixedly butt attached to plate 22 at four equally spaced locations by bolts 26*a*. The other ends of rods 26 are butt attached to ground plane 18 and the circumferential positions of the rod ends are adjustable by means of slots 18*a*. A plurality of holes 27 spaced about the periphery of plate 22 are used to mount structure 25 and radome 30 to parabolic dish 12 as will be illustrated below. Two of holes 27 are countersunk from the opposite side of plate 22 to permit structure 25 to be fastened to dish 12 before the radome is in place as will be explained with respect to FIG. 5. Two holes 29 permit cables (not shown) from antenna array 14 to pass therethrough.

Figure 4:
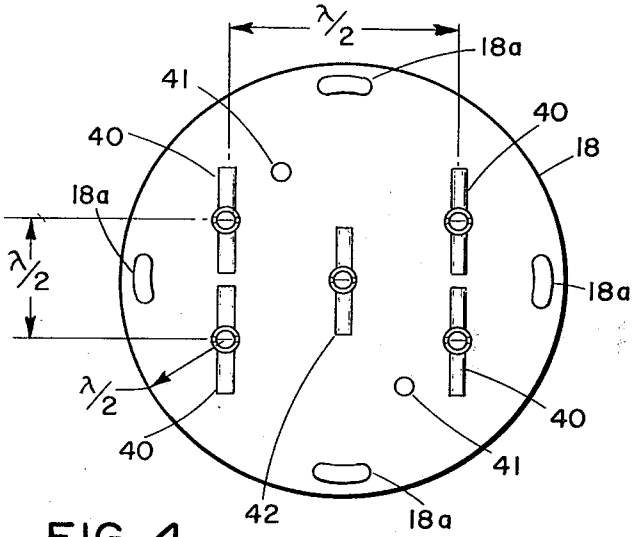
FIG. 4 shows a plan view of the dipole array together with the dipole ground plane.

Refer now to FIG. 4 which shows ground plane 18 and the dipole elements in plan view. As seen, the ground plane is preferably circular in the plan view divided into four quarters by orthagonal center lines. Each quadrant contains a dipole element 40 with the optional dipole element 42 centrally located on ground plane 18. Each of the dipole elements 40 is located about a quarter wavelength from each ground plane center line, dipoles 40 being mounted on a half wavelength grid. Centered on the ground plane center lines are circumferential slots 18*a*, which are used as previously mentioned to adjust the butt end position of rods 26 against the ground plane. Ground plane 18 is of such diameter that the center line of the mounting hole for each of the dipole elements 40 is about a half wavelength from the periphery of the ground plane. It should be understood that the size of the ground plane is dependent upon two mutually exclusive considerations. First, the ground plane should be as large as possible so that the antenna beam will be relatively sharp. On the other hand, the ground plane should be as small as possible since it is located in the aperture of the antenna and blocks the antenna field of view somewhat. The aforementioned dimensions for the ground plane comprise a nice compromise between these two considerations and additionally provide for slots 18*a* to permit the positional inaccuracy correction which is the object of the invention. In this regard, slots 18*a* are located radially from the center of the ground plane about 0.7 wavelenghts. In other words, the distance between the rods when butt ended on the center lines of the ground plane is about one wavelength, and can be somewhat greater or less than this as will be explained below. The ground plane also includes threaded holes 41 which allow the ground plane to be fixed with respect to dish 12 as will be explained below.

Figure 5:
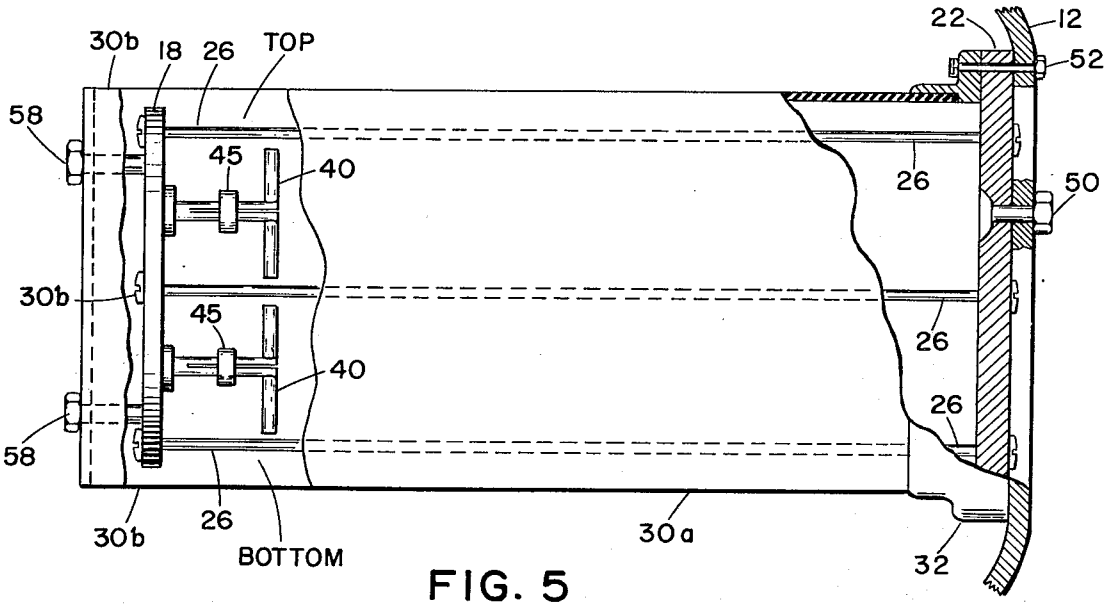
FIGS. 5 and 6 illustrate how the invention can be practiced.
Figure 6:
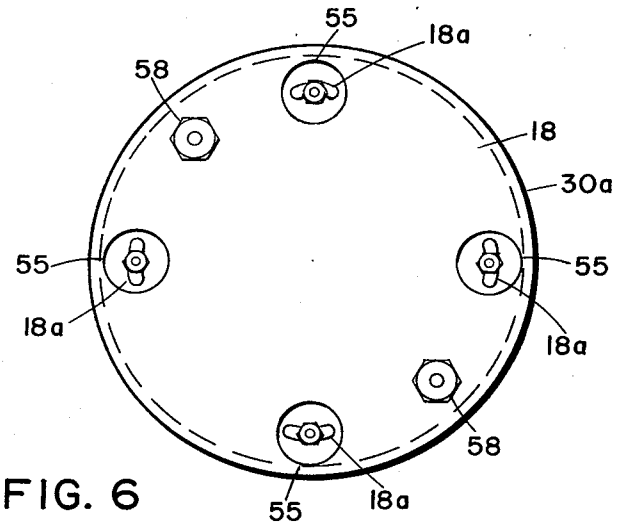

Refer now to FIG. 5 where there is seen structure 25 mounted to parabolic dish 12 and in particular plate 22 fastened to the dish by means of flat headed bolts 50. A radome can then be placed over structure 25 with its flange 32 attached to the dish and plate 22 through a plurality of bolts such as bolts 52. In this embodiment, a modified radome 30*a* can have cutout sections 31 (not shown) adjacent to dipoles 40 for the purposes of permitting access for adjustment of collars 45. Referring in addition to FIG. 6, an end view of the modified radome 30*a* is seen wherein holes 55 permit access to slots 18*a* and the bolts holding the butt ends of rods 26 against ground plane 18 for adjustment of rods 26 after which these bolts are tightened to maintain the rods in their adjusted position. Returning to FIG. 5 it can be seen that a plurality of bolts 58 through the end of the radome fixedly hold ground plane 18 with respect to dish 12. In other words, rods 26 perform essentially no structural function, their function being to compensate for position inaccuracies as previously mentioned and also to provide a convenient means for spacing ground plane 18 from dish 12, it being understood that after adjustment of rods 26 test radome 30*a* is replaced by a standard radome 30 and the ground plane again fixed with respect to dish 12 by means identical to bolts 58.

As previously mentioned, all dipole elements 40 and 42 are polarized alike, usually vertically. In addition, a source of similarly polarized radar signals is placed in the antenna far field on the antenna boresight axis. The radar source is then rotated so that it remains on the antenna boresight axis but is now cross polarized with respect to the receiving antenna and the apparent shift of the radar source from the boresight axis noted. Rods 26 are then adjusted as previously explained to bring the apparent location of the radar source back to the antenna boresight axis. In particular, apparent elevation shifts are corrected by adjusting the top and bottom rods as a set. Apparent shifts in azimuth are corrected by adjusting the side rods.

In an antenna actually built and operating at 1660 to 1700 Mhz it was found that without the positional error compensation herein described a rotation of the transmitter field by 45° caused an azimuth and elevation pointing error ranging to 0.3°. However, by adjusting rods 26 the pointing error over the same range of cross polarization was decreased to zero for both azimuth and elevation.

Figure 8:
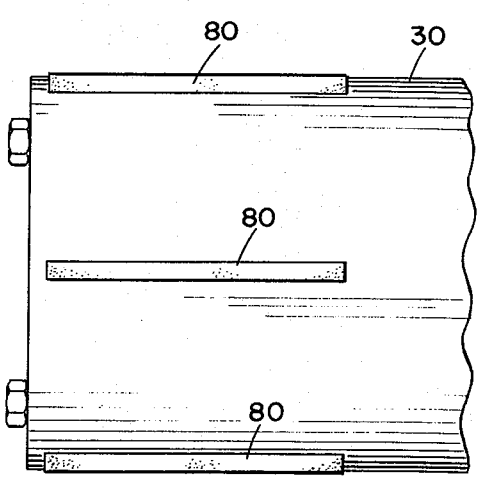
FIGS. 7 and 8 show modifications of the invention.
Figure 7:
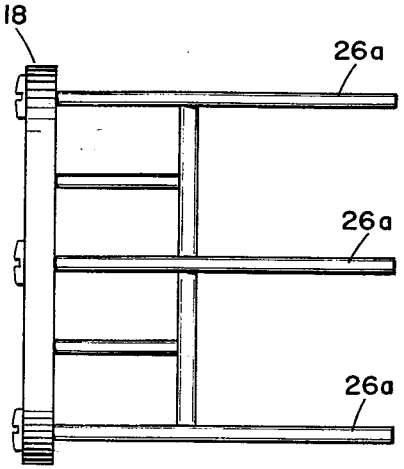

It has been found that the entire lengths of rods 26 are not required to practice the present invention, only the portion extending about one wavelength from ground plane 18 being required. Accordingly, rods 26 can be replaced by shorter rods such as rods 26*a* illustrated in FIG. 7. It has also been found that the rods can be eliminated completely and metalic strips corresponding to the rods and conveniently located external to radome 30 can be substituted. This embodiment is illustrated in FIG. 8 where thin metallic strips 80 are shown equally spaced about the exterior surface of radome 30. As should now be obvious, to compensate for positional inaccuracies strips 80 are displaced laterally to a compensating position and then locked in place, suitably by means of an adhesive.

Having described this invention and various modifications thereof it should now be clear that other modifications and alterations will suggest themselves to one skilled in the art. Accordingly, the invention is to be limited only by the true scope and spirit of the appended claims.

The invention claimed is:

1. Apparatus for correcting the positional inaccuracy of an antenna having a parabolic dish and an antenna element array spaced apart from said parabolic dish and directed into said dish, said antenna element array having at least four antenna elements polarized alike and displaced with orthagonal symmetry about the boresight axis of said antenna comprising:

a ground plane for said antenna elements;

means for fixedly holding said ground plane spaced apart from said parabolic dish and parallel thereto with said four antenna elements displaced with orthagonal symmetry about the boresight axis of said antenna; and, four elongated electrically conductive elements each having a relatively small cross sectional area arranged about said antenna elements equally spaced radially from said boresight axis and generally parallel thereto and generally equally angularly spaced about one wavelength apart, the spacing being adjustable.

2. The apparatus of claim 1 wherein said antenna elements are spaced on a grid of about one-half wavelength, each said antenna element being about one quarter wavelength from orthagonal center lines of said ground plane.

3. The apparatus of claim 2 wherein said ground plane is circular having a diameter of about two wavelengths.

4. The apparatus of claim 1 wherein said antenna elements comprise dipoles.

5. The apparatus of claim 4 wherein said dipoles are vertically polarized.

6. The apparatus of claim 1 wherein said elongated elements comprise rods connected between said ground plane and said dish, said rods being fixedly butt fastened at one end thereof to said dish and adjustably butt fastened at the other end thereof to said ground plane.

7. The apparatus of claim 1 including a cylindrical radome fastened over said ground plane and antenna elements, the sides of said radome being generally perpendicular to said ground plane, said elongated electrically conductive elements being attached to the sides of said radome.

8. The apparatus of claim 1 wherein said elongated electrically conductive elements are adjustably butt fastened to said ground plane by means of circumferential slots in said ground plane.

9. The apparatus of claim 8 wherein said antenna elements comprise dipoles spaced on a grid of about one-half wavelength, each dipole being about one quarter wavelength from orthagonal center lines of said ground plane, said dipoles being polarized parallel to one of said center lines and said elongated electrically conductive elements are butt fastened to said ground plane normally on said center lines.

* * * * *